US005853142A

United States Patent [19]

Anderson

[11] Patent Number: 5,853,142

[45] Date of Patent: Dec. 29, 1998

[54] HOSE GUIDE DEVICE

[76] Inventor: John V. Anderson, 3620 Terry Lake Rd., Fort Collins, Colo. 80524

[21] Appl. No.: 943,800

[22] Filed: Oct. 3, 1997

Related U.S. Application Data

[60] Provisional application No. 60/028,346 Oct. 15, 1996.

[51] Int. Cl.[6] ..... B65H 57/14

[52] U.S. Cl. ..... 242/615.2; 137/355.16

[58] Field of Search ..... 242/615.1, 615.2, 242/615.3, 615.4; 137/355.16; 254/395

[56] References Cited

U.S. PATENT DOCUMENTS

| | | | |
|---|---|---|---|
| 1,831,306 | 11/1931 | Kakimoto | 242/615.2 |
| 1,857,293 | 5/1932 | Vroom . | |
| 1,933,655 | 11/1933 | Brooks . | |
| 1,968,357 | 7/1934 | Schmiett | 242/615.2 |
| 2,264,751 | 12/1941 | Maxtone-Graham | 242/615.2 |
| 2,501,407 | 3/1950 | Olsen et al. | 242/615.2 |
| 2,603,432 | 7/1952 | Paulsen | 242/615.2 |
| 2,618,465 | 11/1952 | Austin, Jr. . | |
| 2,657,012 | 10/1953 | Whitlock . | |
| 2,814,460 | 11/1957 | Marcolongo | 242/615.2 |
| 2,816,734 | 12/1957 | Crofoot . | |
| 2,846,189 | 8/1958 | MacLaughlin . | |
| 2,974,933 | 3/1961 | Belanger . | |
| 3,072,384 | 1/1963 | Apichell | 242/615.2 |
| 3,081,978 | 3/1963 | Kaufmann . | |
| 3,249,337 | 5/1966 | Neumann | 242/615.2 |
| 3,829,065 | 8/1974 | Less | 242/615.2 |
| 4,452,386 | 6/1984 | McElyea | 242/615.2 |
| 4,586,676 | 5/1986 | Johnston et al. | 242/615.3 |
| 4,836,432 | 6/1989 | Violette | 242/615 |

FOREIGN PATENT DOCUMENTS

| | | |
|---|---|---|
| 196709 | 3/1908 | Germany . |

*Primary Examiner*—John P. Darling
*Attorney, Agent, or Firm*—Flanagan & Flanagan; John K. Flanagan; John R. Flanagan

[57] ABSTRACT

A hose guide device includes a plurality of rotatable elements and a holder defining a passageway having an arcuate inverted hook shaped profile and an side opening to the passageway spaced downwardly from an upper portion of the holder through which a hose can enter the passageway as the hose is pulled past the device. The rotatable elements are rotatably mounted on the holder so as to dispose the rotatable elements in a generally single file arcuate arrangement conforming in shape to the arcuate inverted hook shaped profile of the holder such that the hose upon entering the passageway through the side opening thereof will slidably contact the rotatable elements and be retained within the passageway of the holder below the upper portion thereof due to the arcuate inverted hook shaped profile of the passageway of the holder and the single file arcuate arrangement of the rotatable elements. The hose guide device also includes elements at opposite ends of the holder for mounting the holder to an external support structure.

15 Claims, 2 Drawing Sheets

HOSE GUIDE DEVICE

This application claims the benefit of U.S. provisional application Ser. No. 60/028,346, filed Oct. 15, 1996.

BACKGROUND OF THE INVENTION

1. Field of the Invention

The present invention generally relates to means for guiding hoses and, more particularly, is concerned with a hose guide device.

2. Description of the Prior Art

Gardeners and others who use garden hoses may drag the hoses with sprinkler attachments or other appliances connected thereto across lawns and/or around corners of buildings so as to place the hoses in desired locations. In the process of dragging a hose, it may inadvertently be moved across beds of plants, causing damage thereto, and past bushes where their attached appliances may snag and catch.

Relocation of hoses in such manner is a frustrating problem for users, requiring them to spend extra time and to expend extra energy to ensure that the hoses and their attached appliances stay clear of flower beds, vegetable gardens and the like, and do not catch on bushes and/or building corners. One proposed solution to this problem which has appeared on the market is a hose guide device having a lower stake portion adapted to be emplaced in the ground and a U-shaped upper portion extending above the ground and providing a slot through which a hose is supposed to travel and be restrained from reaching plant beds and contacting building corners and nearby bushes. However, as a hose is moved relative to the guide device, the hose will slide up a side of the guide until it is released from the slot of the guide device. Also, an appliance connected to the hose may catch on the guide device. Thus, this guide device does not provide an effective solution to the hose relocation problem.

Other solutions proposed in the patented prior art are disclosed in U.S. Pat. No. 1,933,655 to Brooks, U.S. Pat. No. 2,618,465 to Austin, U.S. Pat. No. 2,657,012 to Whitlock, U.S. Pat. No. 2,816,734 to Crofoot, U.S. Pat. No. 2,846,189 to MacLaughlin, U.S. Pat. No. 2,974,933 to Belanger, U.S. Pat. No. 3,081,978 to Kaufmann and U.S. Pat. No. 3,829,065 to Less. While some of these prior art patented devices have designs that might improve hose guidance to a limited extent, none of these prior art devices appears to constitute a comprehensive and effective solution of the problem at hand.

Consequently, a need still exists for a device which provides a solution to the aforementioned problem in the prior art without introducing any new problems in place thereof.

SUMMARY OF THE INVENTION

The present invention provides a hose guide device designed to satisfy the aforementioned need. The hose guide device of the present invention has a shape which is constructed to capture and retain a hose moving within the confines of the guide device and has a plurality of rotatable elements which are arranged on the device along an arcuate path so as to engage the hose as it is pulled past the device in a manner which reduces frictional forces imposed thereon that might otherwise impede movement of the hose past the device and thereby around plant beds, gardens, bushes and building corners.

Accordingly, the present invention is directed to a hose guide device which comprises: (a) a plurality of rotatable elements; (b) a holder defining a passageway having an arcuate inverted hook shaped profile and a side opening to the passageway spaced downwardly from an upper portion of the holder through which a hose can enter the passageway as the hose is pulled past the device; and (c) means for mounting the rotatable elements on the holder so as to dispose the rotatable elements in a generally single file arcuate arrangement conforming in shape to the arcuate inverted hook shaped profile of the passageway of the holder such that the hose upon entering the passageway through the side opening thereof will slidably contact the rotatable elements and be retained within the passageway of the holder below the upper portion thereof due to the arcuate inverted hook shaped profile of the passageway of the holder and the single file arcuate arrangement of the rotatable elements. The device also comprises means for mounting the holder to an external support structure. The external support structure may be the ground, a post, a corner of a building, or the like.

Each of the rotatable elements preferably has a substantially spherical configuration. In a first embodiment of the device, the means for mounting the rotatable elements on the holder are central openings defined through the rotatable elements and the holder is an elongated rod member having a main portion which is disposed through the central openings of the rotatable elements so as to thereby slidably receive and mount the rotatable elements thereover. The main portion of the rod member defines the arcuate inverted hook shaped profile of the passageway and has a pair of opposite ends. The main portion of the rod member captures and holds the plurality of rotatable elements in the single file arcuate arrangement between the opposite ends of the main portion. The rod member also includes opposite upper and lower end portions connected to the opposite ends of the main portion which are bent and turned back over and under the opposite ends of the main portion and terminate in respective upwardly and downwardly projecting ends providing means for mounting the holder to the external support structure.

In the second modified embodiment, the holder is an elongated body member defining the arcuate inverted hook shaped profile of the passageway. The means for mounting the rotatable elements on the holder is a central channel defined in the body member rotatably receiving and retaining the rotatable elements therein and at least one slot extending along the central channel and exposing the rotatable elements at the exterior of the body member. The slot permits the hose to slidably contact the rotatable elements and to be slidably retained by the arcuate inverted hook shaped profile of the passageway of the body member. The body member thus has a shape that serves a function substantially similar to that of the rod member. The body member also includes upper and lower end portions which provide the means for mounting the holder to the external support structure.

The means for mounting the holder to an external support structure can be substantially the same or similar for both of the above-described embodiments of the device. The external support structure mounting means enables the direct attachment of the upper end portion of the rod or body member to the external support member or of the lower end portion of the rod or body member to the external support member. The external support structure mounting means may further enable insertion of the downwardly projecting end of the lower end portion of the rod or body member into the ground as the external support member to mount the device in a free-standing manner away from any other support structure.

The device also includes deflector means on the holder extending outwardly from opposite sides of a lower portion of the holder generally below the side opening to the passageway so as to cover any space betweem the lower portion of the holder and the external support structure to thereby prevent entry into the space of any portion of an appliance attached to and moved with the hose.

These and other features and advantages of the present invention will become apparent to those skilled in the art upon a reading of the following detailed description when taken in conjunction with the drawings wherein there is shown and described an illustrative embodiment of the invention.

BRIEF DESCRIPTION OF THE DRAWINGS

In the following detailed description, reference will be made to the attached drawings in which.

DETAILED DESCRIPTION OF THE INVENTION

Figures 1, 2:
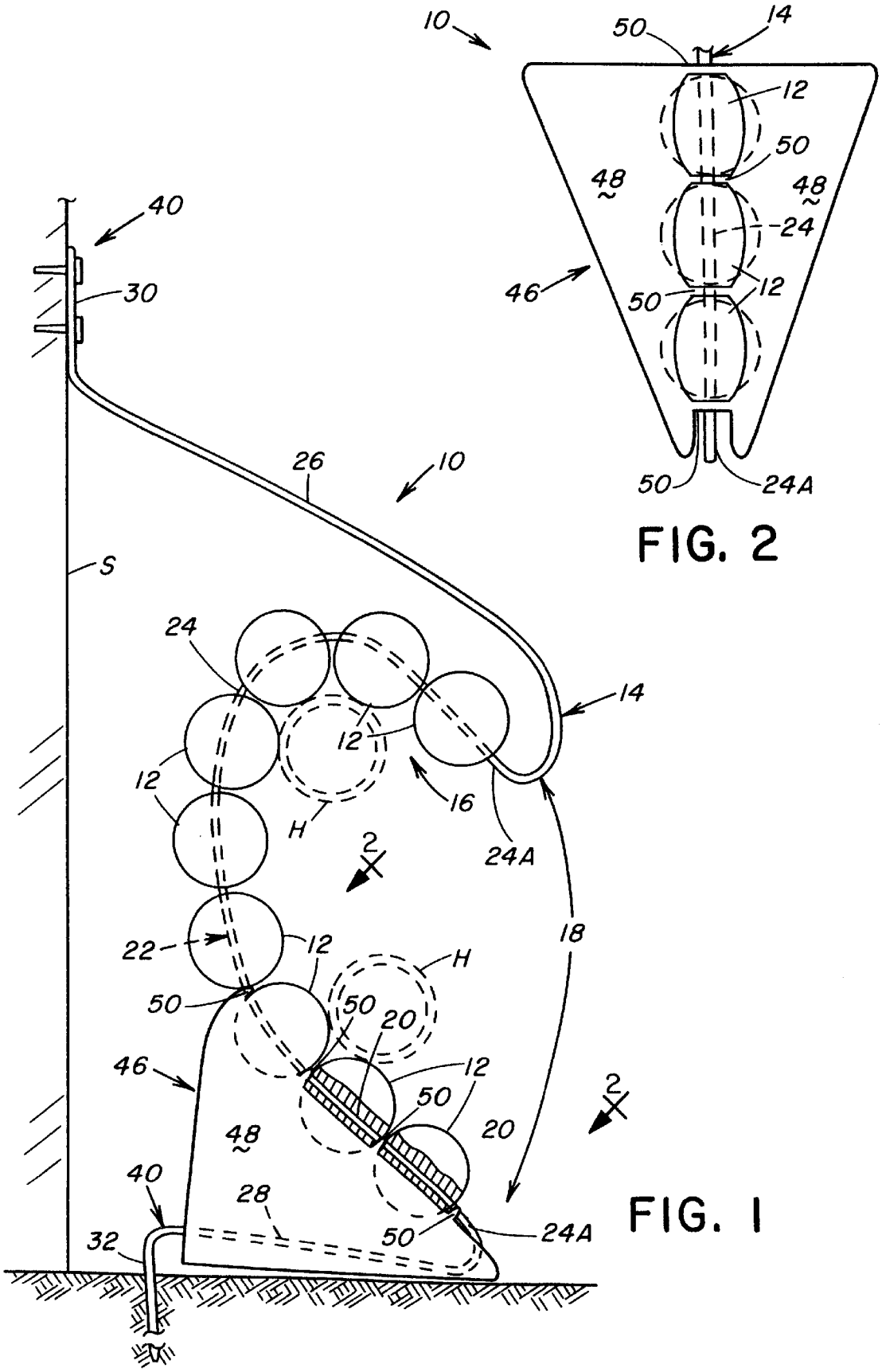
FIG. 1 is a side elevational and partially sectional view of a first embodiment of a hose guide device of the present invention showing portions of both an elongated rod member and plurality of rotatable elements of the device in phantom.
FIG. 2 is a top plan view of the hose guide device as seen along line 2—2 of FIG. 1 and showing portions of both the rod member and rotatable elements in phantom.
Figure 3:
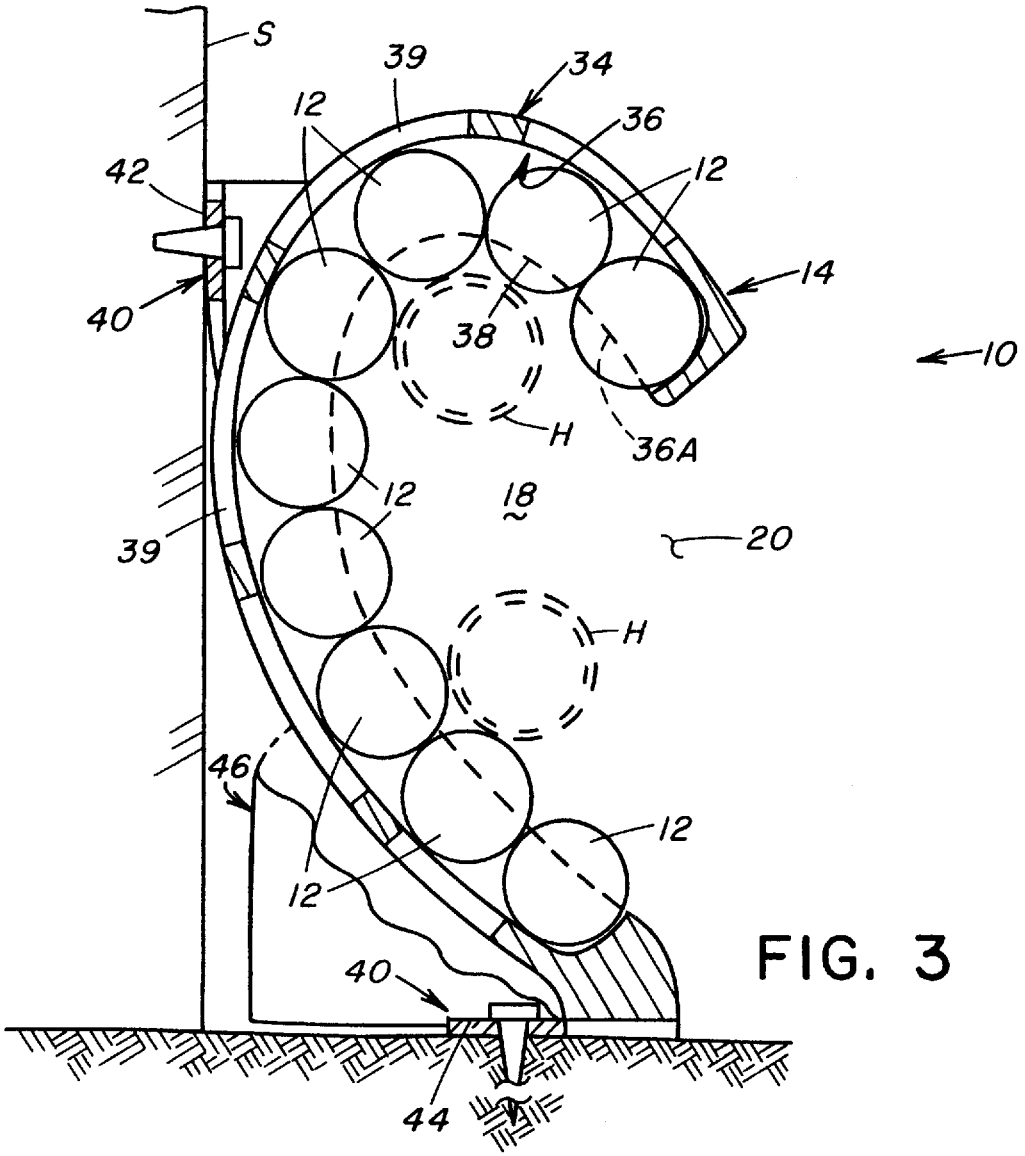
FIG. 3 is a side elevational and partially sectional view of a second modified embodiment of the hose guide device of the present invention showing portions of both an elongated body member and a plurality of rotatable elements of the device in phantom.

Referring to the drawings and particularly to FIGS. 1 and 3, there is illustrated two embodiments of a hose guide device, generally designated 10, of the present invention. With respect to both embodiments, the hose guide device 10 basically includes a plurality of rotatable elements 12 and a holder 14 having an arcuate inverted hook shaped profile defining a passageway 16 through the holder 14 and a side opening 18 to the passageway 16 through which a hose H (only being shown in cross-sectional dashed line form in FIG. 1) can enter the passageway 16 as the hose is pulled past the device 10. Each of the rotatable elements 12 preferably but not necessarily is substantially round in configuration. The rotatable elements 12 are mounted on the holder 14 so as to be disposed in a generally single file end-to-end arcuate or curved shaped arrangement within the passageway 16 that conforms in configuration to the arcuate inverted hook shaped profile of the passageway 16 of the holder 14. The hose upon entering the passageway 16 through the side opening 18 can slidably contact and engage the various ones of the rotatable elements 12 and will be retained within the passageway 16 of the holder 14 due to the arcuate inverted hook shaped profile of the passageway 16 and the single file arcuate arrangement of the rotatable members 12.

As mentioned above, the rotatable elements 12 preferably have substantially spherical configurations, but may have other suitable shapes. Each rotatable element 12 is thus preferably a ball or bead which can be either of a solid or hollow construction and made of any suitable material, such as plastic or metal. In the first embodiment of the hose guide device 10 seen in FIGS. 1 and 2, each rotatable element 12 has a central bore or opening 20 or the like. In the second or modified embodiment of the hose guide device 10 seen in FIG. 3, the rotatable elements 12 do not have the central openings 20 as defined in the rotatable elements 12 of the first embodiment.

In the first embodiment of the hose guide device 10 of FIGS. 1 and 2, the holder 14 more particularly is in the form of an elongated wire or rod member 22. The rod member 22 may be made of any suitable material, such as metal or plastic, can have any suitable diameter, and may be stiff or bendable. The rod member 22 has a main portion 24 disposed through the central openings 20 of the rotatable elements 12 so as to thereby slidably receive and mount the rotatable elements 12 thereover. The main portion 24 of the rod member 22 in resembling the profile of a human ear defines the arcuate inverted hook shaped profile of the passageway 16 and has a pair of opposite ends 24A. The main portion 24 of the rod member 22 captures and holds the rotatable elements 12 in the single file arcuate arrangement between the opposite ends 24A of the main portion 24. The rod member 22 also includes opposite upper and lower end portions 26, 28 integrally connected to the opposite ends 24A of the main portion 24 which are bent and turned back over and under the opposite ends 24A of the main portion 24 and terminate in respective upwardly and downwardly projecting ends 30, 32. The rotatable elements 12 can rotate relative to the main portion 24 of the rod member 12 when contacted by the hose H and thereby facilitate movement of the hose past the hose guide device 10 without catching thereon. The arcuate inverted hook shaped profile of the main portion 24 of the rod member 22, the single file arcuate arrangement of the rotatable elements 12, and the spinning of the rotatable elements 12 on the main portion 24 of the rod member 22 all contribute to capturing and retaining the moving hose H within the perimeter of the hose guide device 10 as the hose is pulled past the device 10.

Figure 4:
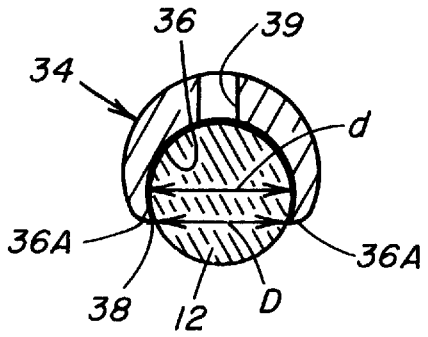
FIG. 4 is a cross-sectional view of the body member taken along line 4—4 of FIG. 3.

In the second or modified embodiment of the hose guide device 10 of FIGS. 3 and 4, the holder 14 is in the form of an elongated body member 34 defining the arcuate inverted hook shaped profile of the passageway 16. The body member 34 also forms an elongated central channel 36 on an interior side of the body member 34 that rotatably receives and retains the rotatable elements 12 therein so as to thereby mount them in the single file arcuate shaped arrangement on the holder 14. The central channel 36 has a circular cross-sectional shape which extends through an arc greater than 180° so as to defining terminating lips 36A spaced apart through a distance D that is less than the diameter "d" of each of the rotatable elements 12 such that each of the rotatable elements 12 is retained by the lips 36A in the central channel 36. The body member 34 further defines at least one elongated slot 38 extending between the lips 36A along the front side of the body member 34, but preferably also an opposite elongated slot 39 which extends along the back side of the body member 34. Both the front and back slots 38, 39 communicate with the central channel 36. The rotatable elements 12 extend through the front slot 38 and thus are exposed at the exterior of the body member 34 within the passageway 16 so as to permit the hose H to slidably contact the rotatable elements 12 and to be slidably retained within the passageway 16 by the arcuate inverted hook shaped profile of the body member 34. The rear slot 39 assists in easy flushing of dirt and debris from the channel 36 by spraying of water thereon. It can be readily understood that the body member 34 of the second embodiment of the device 10 has substantially the same overall shape and function as that of the rod member 22 of the first embodiment of the device 10.

The hose guide device 10 also includes means, generally designated 40, for mounting the holder 14 to a suitable external support structure S. Depending upon the location where it is desired to place and support the hose guide device 10, the external support structure S may be the ground, a post, a corner of a building, or the like. In the first embodiment of the device 10 in FIGS. 1 and 2, the upwardly and downwardly projecting ends 30, 32 of the rod member 22 constitute the external support structure mounting means 40. In the second embodiment of the device 10 in FIGS. 3 and 4, opposite upper and lower end flanges or lugs 42, 44 constitute the external support structure mounting means 40. Thus, the mounting means 40 are provided which by the use of suitable attachment means, such as nails, screws or the like, facilitate attachment of the upper portion of the holder 14 in either embodiment to an external support structure, such as a post or building, and by the use of suitable anchoring means, such as stakes, facilitate attachment of the lower portion of the holder 14 in either embodiment to an external support structure, such as the ground. The downwardly projecting end 32 may itself be inserted into the ground to mount the device 10 in a free-standing manner away from any other support structure.

Finally, the hose guide device 10 may also include a deflector member 46 extending outwardly from opposite sides of a lower portion of the holder 14 in either embodiment. The deflector member 46 is disposed generally below the side opening 18 to the passageway 16 of the holder 14 so as to cover any space between the lower portion of the holder 14 and the respective external support structure S to thereby prevent entry into the space of any portion of an appliance attached to and moved with the hose H. More particularly, in the first and second embodiment the deflector member 46 can take the form of a pair of side wall portions 48 and a plurality of bridge portions 50 integral therewith and extending over and about the lower portion of the rod member 22 so as to support the pair of side wall portions 48 extending in opposite directions outwardly and downwardly from the rod member 22. The deflector member 46 may be comprised of any suitable material, such as metal or plastic. The term "hose" as used herein is meant to also include other items such as electrical cords and the like.

It is thought that the present invention and its advantages will be understood from the foregoing description and it will be apparent that various changes may be made thereto without departing from the spirit and scope of the invention or sacrificing all of its material advantages, the form hereinbefore described being merely preferred or exemplary embodiment thereof.

I claim:

1. A hose guide device, comprising:

(a) a plurality of rotatable elements;

(b) a holder defining a passageway having an arcuate inverted hook shaped profile and an side opening to said passageway extending downwardly from an upper portion of said holder through which a hose can enter said passageway as the hose is pulled past said device; and (c) means for mounting said rotatable elements on said holder so as to dispose said rotatable elements in a generally single file arcuate arrangement conforming in configuration to said arcuate inverted hook shaped profile of said passageway of said holder such that the hose upon entering said passageway through said side opening thereof will slidably contact said rotatable elements and be retained within said passageway of said holder below said upper portion thereof due to said arcuate inverted hook shaped profile of said passageway and said single file arcuate arrangement of said rotatable elements, said means for mounting said rotatable elements on said holder being central openings defined through said rotatable elements;

(d) said holder being an elongated rod member having a main portion disposed through said central openings of said rotatable elements so as to thereby slidably receive and mount said rotatable elements thereover, said main portion of said rod member defining said arcuate inverted hook shaped profile of said passageway and having a pair of opposite ends, said rod member further having opposite upper and lower end portions respectively connected to said opposite ends of said main portion and being bent and respectively turned back over and under said opposite ends of said main portion, said opposite upper and lower end portions of said rod member terminate in respective upwardly and downwardly projecting ends to provide means for mounting said holder to said external support structure.

2. The device of claim 1 wherein each of said plurality of rotatable elements has a substantially spherical configuration.

3. The device of claim 1 wherein said holder is an elongated body member defining said arcuate inverted hook shaped profile of said passageway and said means for mounting said rotatable elements on said holder is a central channel defined by said body member rotatably receiving and retaining said rotatable elements therein.

4. A hose guide device, comprising:

(a) a plurality of rotatable elements;

(b) a holder defining a passageway having an arcuate inverted hook shaped profile and an side opening to said passageway extending downwardly from an upper portion of said holder through which a hose can enter said passageway as the hose is pulled past said device;

(c) means for mounting said rotatable elements on said holder so as to dispose said rotatable elements in a generally single file arcuate arrangement conforming in configuration to said arcuate inverted hook shaped profile of said passageway of said holder such that the hose upon entering said passageway through said side opening thereof will slidably contact said rotatable elements and be retained within said passageway of said holder below said upper portion thereof due to said arcuate inverted hook shaped profile of said passageway and said single file arcuate arrangement of said rotatable elements; and (d) a deflector means on said holder extending outwardly from opposite sides of a lower portion of said holder generally below said side opening to said passageway so as to cover any space between said lower portion of said holder and the external support structure to thereby prevent entry into the space of any portion of an appliance attached to and moved with the hose.

5. The device of claim 4 further comprising: means for mounting said holder to external support structure.

6. A hose guide device, comprising:

(a) a plurality of rotatable elements each having a substantially spherical configuration and a central opening defined therethrough; and (b) a holder including an elongated rod member defining a passageway having an arcuate inverted hook shaped profile and an side opening to said passageway extending downwardly from an upper portion of said holder through which a hose can enter said passageway as the hose is pulled past said device, said main portion of said rod member being disposed through said central openings of said rotatable elements so as to thereby slidably receive and mount said rotatable elements thereover in a generally single file arcuate arrangement conforming in configuration to said arcuate inverted hook shaped profile of said passageway such that the hose upon entering said passageway through said side opening thereof will slidably contact said rotatable elements and be retained within said passageway of said rod member below said upper portion thereof due to said arcuate inverted hook shaped profile of said passageway of said rod member and said single file arcuate arrangement of said rotatable elements;

(c) said rod member further having opposite upper and lower end portions respectively connected to opposite ends of said main portion and being bent and respectively turned back over and under said opposite ends of said main portion, said opposite upper and lower end portions of said rod member capturing said rotatable elements therebetween over said main portion of said rod member.

7. The device of claim 6 wherein said upper and lower end portions of said rod member terminate in respective upwardly and downwardly projecting ends providing means for mounting said holder to the external support structure.

8. A hose guide device, comprising:

(a) a plurality of rotatable elements;

(b) a holder defining a passageway having an arcuate inverted hook shaped profile and an side opening to said passageway extending downwardly from an upper portion of said holder through which a hose can enter said passageway as the hose is pulled past said device; and (c) means for mounting said rotatable elements on said holder so as to dispose said rotatable elements in a generally single file arcuate arrangement conforming in configuration to said arcuate inverted hook shaped profile of said passageway of said holder such that the hose upon entering said passageway through said side opening thereof will slidably contact said rotatable elements and be retained within said passageway of said holder below said upper portion thereof due to said arcuate inverted hook shaped profile of said passageway and said single file arcuate arrangement of said rotatable elements;

(d) said holder being an elongated body member defining said arcuate inverted hook shaped profile of said passageway;

(e) said means for mounting said rotatable elements on said holder being a central channel defined by said body member rotatably receiving and retaining said rotatable elements therein;

(f) said holder also having at least one slot defined in said body member extending along said central channel and exposing said rotatable elements at the exterior of said body member permitting the hose to slidably contact said rotatable elements.

9. The device of claim 8 wherein said body member further has opposite upper and lower end lugs connected to said body member to provide means for mounting said holder to the external support structure.

10. A hose guide device, comprising:

(a) a plurality of rotatable elements each having a substantially spherical configuration and a central opening defined therethrough;

(b) a holder including an elongated rod member defining a passageway having an arcuate inverted hook shaped profile and an side opening to said passageway extending downwardly from an upper portion of said holder through which a hose can enter said passageway as the hose is pulled past said device, said main portion of said rod member being disposed through said central openings of said rotatable elements so as to thereby slidably receive and mount said rotatable elements thereover in a generally single file arcuate arrangement conforming in configuration to said arcuate inverted hook shaped profile of said passageway such that the hose upon entering said passageway through said side opening thereof will slidably contact said rotatable elements and be retained within said passageway of said rod member below said upper portion thereof due to said arcuate inverted hook shaped profile of said passageway of said rod member and said single file arcuate arrangement of said rotatable elements; and (c) a deflector means on said rod member extending outwardly from opposite sides of a lower portion of said rod member generally below said side opening to said passageway so as to cover any space between said lower portion of said holder and the external support structure to thereby prevent entry into the space of any portion of an appliance attached to and moved with the hose.

11. The device of claim 10 further comprising:

means for mounting said holder to external support structure.

12. A hose guide device, comprising:

(a) a plurality of rotatable elements each having a substantially spherical configuration; and (b) a holder including an elongated body member defining a passageway having an arcuate inverted hook shaped profile and an side opening to said passageway extending downwardly from an upper portion of said holder through which a hose can enter said passageway as the hose is pulled past said device, said body member forming a central channel rotatably receiving and retaining said rotatable elements therein in a generally single file arcuate arrangement conforming in configuration to said arcuate inverted hook shaped profile of said body member, said body member also having at least one slot extending along said central channel and exposing said rotatable elements at the exterior of said body member such that the hose upon entering said passageway through said side opening thereof will slidably contact said rotatable elements and be retained within said passageway of said rod member below said upper portion thereof due to said arcuate inverted hook shaped profile of said passageway of said body member and said single file arcuate arrangement of said rotatable elements.

13. The device of claim 12 further comprising:

means for mounting said holder to external support structure.

14. The device of claim 13 wherein said body member further has opposite upper and lower end lugs to provide said means for mounting said holder to the external support structure.

15. The device of claim 12 further comprising:

deflector means on said holder extending outwardly from opposite sides of a lower portion of said holder generally below said side opening to said passageway so as to cover any space between said lower portion of said holder and the external support structure to thereby prevent entry into the space of any portion of an appliance attached to and moved with the hose.

* * * * *